US006496670B1

(12) United States Patent
Ishikita et al.

(10) Patent No.: US 6,496,670 B1
(45) Date of Patent: Dec. 17, 2002

(54) IMAGE-FORMING APPARATUS HAVING UPRIGHT CONSTRUCTION

(75) Inventors: Akira Ishikita, Tokyo (JP); Yoshihiko Michitsuji, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/677,388

(22) Filed: Oct. 2, 2000

(30) Foreign Application Priority Data

Oct. 5, 1999 (JP) ..... 11-284282

(51) Int. Cl.[7] ..... G03G 15/00
(52) U.S. Cl. ..... 399/107; 399/393; 399/405
(58) Field of Search ..... 399/107, 110, 399/124, 108, 393, 405, 407, 23, 16

(56) References Cited

U.S. PATENT DOCUMENTS 3,947,018 A * 3/1976 Stange
4,640,602 A * 2/1987 Redding et al. ..... 399/393
5,065,197 A * 11/1991 Mitsuyama ..... 399/381
5,331,389 A * 7/1994 Fukuchi et al. ..... 271/287
5,787,324 A * 7/1998 Iwasaki ..... 399/112
5,799,230 A * 8/1998 Lloyd ..... 399/107
6,098,975 A * 8/2000 Kobayashi ..... 270/58.09
6,290,223 B1 * 9/2001 Roux et al. ..... 271/10.03
6,336,016 B1 * 1/2002 Ikeda ..... 399/107

FOREIGN PATENT DOCUMENTS

JP 04-179630 * 6/1992
JP 06-255817 * 9/1994
JP 10291711 A * 11/1998 ..... B65H/31/24

* cited by examiner

*Primary Examiner*—Robert Beatty
(74) *Attorney, Agent, or Firm*—Akin, Gump, Strauss, Hauer & Feld, L.L.P.

(57) ABSTRACT

An image-forming apparatus is of upright construction and includes a medium-feeding section, an image-forming section, and stacker. The medium-feeding section accommodates a stack of print medium in an upright origatation. The image-forming section is disposed in vertical alignment with the medium-feeding section, and prints information on a page of the print medium fed from the medium-feeding section. The stacker is disposed in vertical alignment with the image forming section, and receives the printed page of the print medium and accommodates the page of the print medium in an upright orientation. The image-forming section is above the medium feeding section and the stacker is above the image-forming section. The stacker may have a sensor that generates a detection signal of the print medium when the print medium is received therein. The detection signal is used to provide a visible indication, i.e., an alarm that informs the user of the presence and absence of the print medium.

7 Claims, 8 Drawing Sheets

IMAGE-FORMING APPARATUS HAVING UPRIGHT CONSTRUCTION

BACKGROUND OF THE INVENTION

1. Field of the Invention

The present invention relates to art image-forming apparatus.

2. Description of the Related art

An image-forming apparatus for personal use, including a copying machine and a printer, is usually of small size and is placed on a desk. Such an apparatus incorporates a sheet feeder that holds a stack of print medium such as paper in an inclined position. The paper is fed from the sheet feeder and then information is printed on the paper. The paper is then discharged to a paper stack at either the front end or the rear end of the image-forming apparatus.

An image-forming apparatus for office use is of large size and incorporates a paper-feeding section having paper cassettes that hold a stack of print medium lying horizontal, or has paper cassettes that hold a stack of print medium therein and obliquely project outwardly from the main body of the apparatus. Such paper cassettes usually take up as large an area as one complete desk or a half of it.

An apparatus for personal use occupies a considerable area on the desk, leaving only a limited space where the user can do deskwork. This makes the clerical work inefficient. A large-size apparatus occupies a relatively large area at a corner in the office, making the remaining office space small.

BRIEF SUMMARY OF THE INVENTION

The present invention was made in view of the aforementioned drawbacks of the conventional apparatus. An image-forming apparatus is of upright construction. A medium-feeding section accommodates a stack of print medium. An image-forming section is disposed in vertical alignment with the medium-feeding section, the image-forming section printing information on a page of the print medium fed from the medium-feeding section. A stacker is disposed in vertical alignment with the image-forming section. The stacker receives the page of the print medium that has been printed and accommodates the page of the print medium in an upright orientation.

The image-forming section is above the medium-feeding section and the stacker is above the image-forming section.

The stacker may have a visible indicator by which a user can detect the presence and absence of the print medium.

The stacker may have a sensor that generates a detection signal when the print medium is received therein. The visible indication is an alarm that informs the user of the presence and absence of the print medium in the stacker according to the detection signal.

The stacker may have a transparent portion that serves as the visible indicator.

The medium-feeding section accommodates the stack of print medium that is at least partly curved.

The image-forming section is a tandem type electrophotographic apparatus with a plurality of image drum cartridges that are disposed in vertical alignment with one another.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE SEVERAL VIEWS OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail by way of example.

First Embodiment

Figure 1:
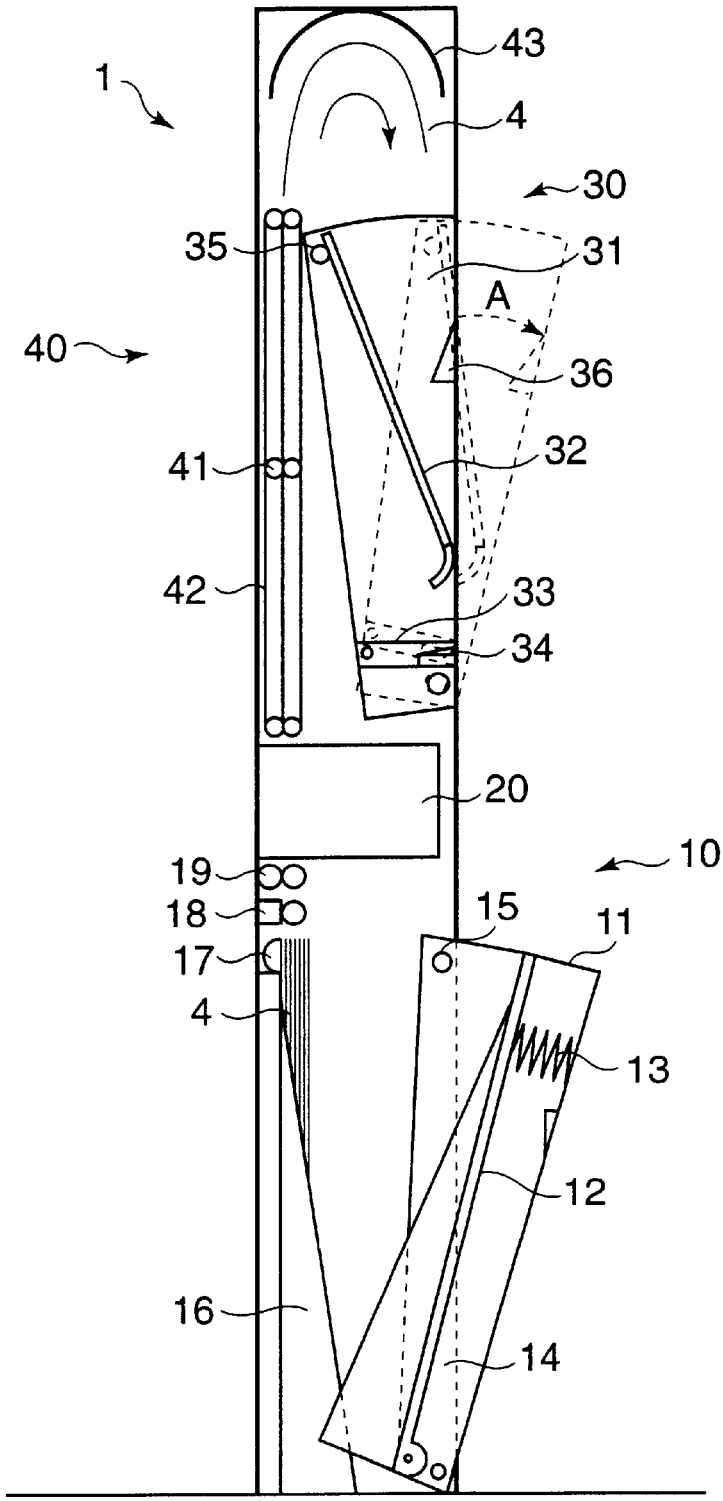
FIG. 1 is a cross-sectional view of a printer according to a first embodiment of the invention.

FIG. 1 is a cross-sectional view of a printer according to a first embodiment of the invention.

Figure 2:
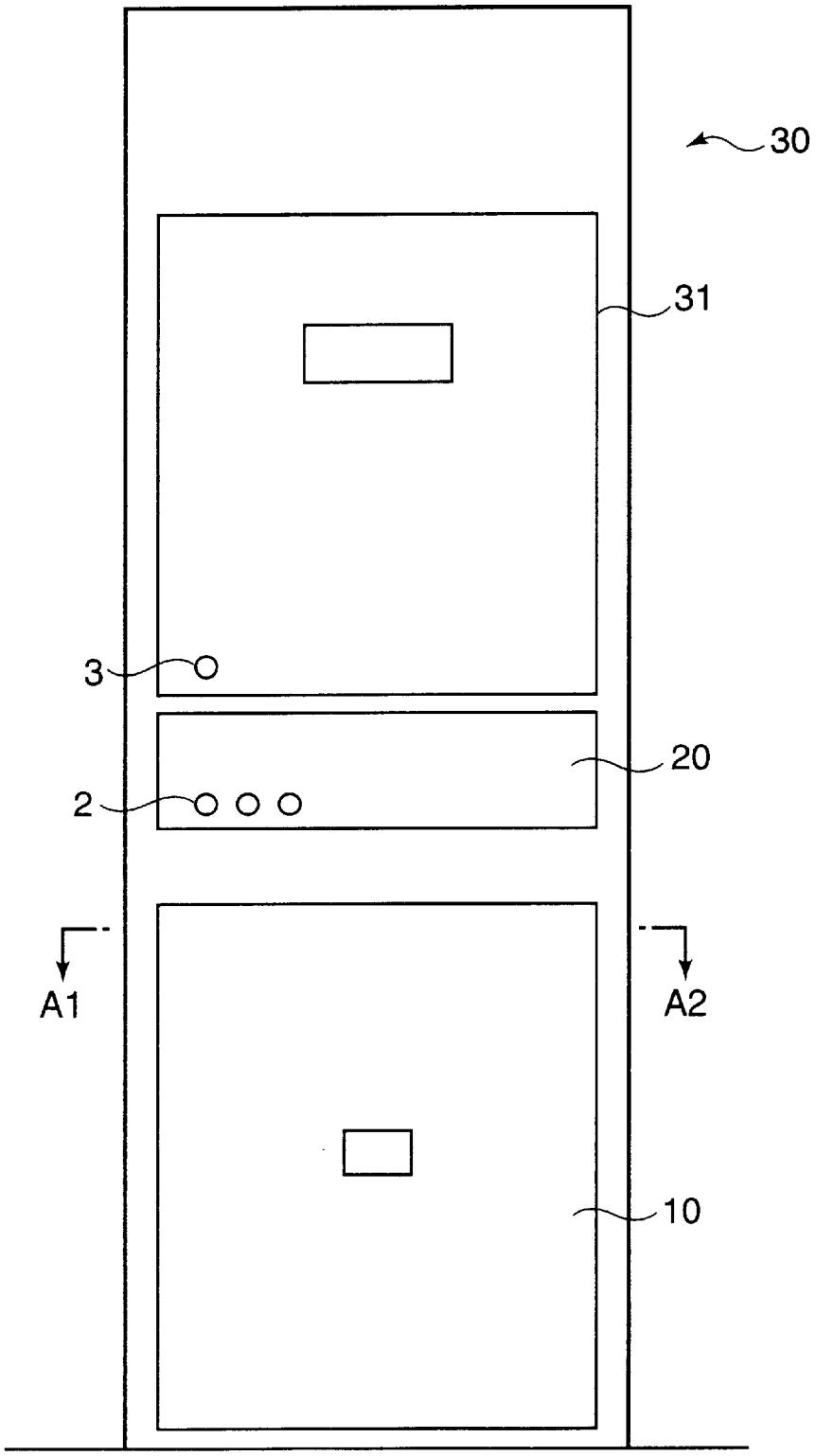
FIG. 2 is a front view of the printer.

FIG. 2 is a front view of the printer.

FIG. 3 is a cross-sectional view taken along lines III—III of FIG. 2.

A printer according to the present invention will be described as being installed on the floor of an office. Referring to FIG. 1, a paper-feeding section 10, an image-forming section 20, and a transporting section 40 are disposed in vertical alignment with one another. The image-forming section is disposed over the paper-feeding section 10. Above the image-forming section 20 are a stacker 30 and a transporting section 40 disposed side by side. The transporting section 40 transports a print medium such as paper from the image-forming section 20 to the stacker 30. These sections 10, 20, 30, and 40 are housed in a main body 1.

The overall structure of the image-forming apparatus will be described.

A stack of print medium is accommodated in an upright position and each page of the print medium is fed in an upright position from the paper-feeding section 10. The image-forming section 20 has a display 2 which displays the status of the image-forming section. The stacker 30 has a display 3 that displays whether the printed medium is present in or absent from the stacker 30. The respective sections will be described in detail.

{Paper-feeding Section}

FIG. 1 illustrates the paper-feeding section 10 when it is opened. The paper-feeding section 10 is of a structure in which a stack of print medium is accommodated in an upright position. The paper-feeding section 10 includes a movable part and a stationary part. The movable part includes a print medium cassette 11 whose lower end is hingedly mounted to the main body so that when the cassette 11 is inclined outwardly the cassette 11 opens at an upward end thereof. The cassette 11 includes a guide plate 12, a spring 13 that urges the guide plate 12 in a direction shown by arrow B against the main body 1, a guide 14, and a stopper 15 that guides the cassette 11 such that the cassette 11 is not disengaged from the main body.

The stationary part of the paper-feeding section 10 is fixed to the main body 1 and includes a guide 16, a hopping roller 17, a separator 18, and a registry roller 19.

The paper-feeding section 10 will be described in more detail with reference to FIGS. 1 and 3A–3C.

Figure 3A:
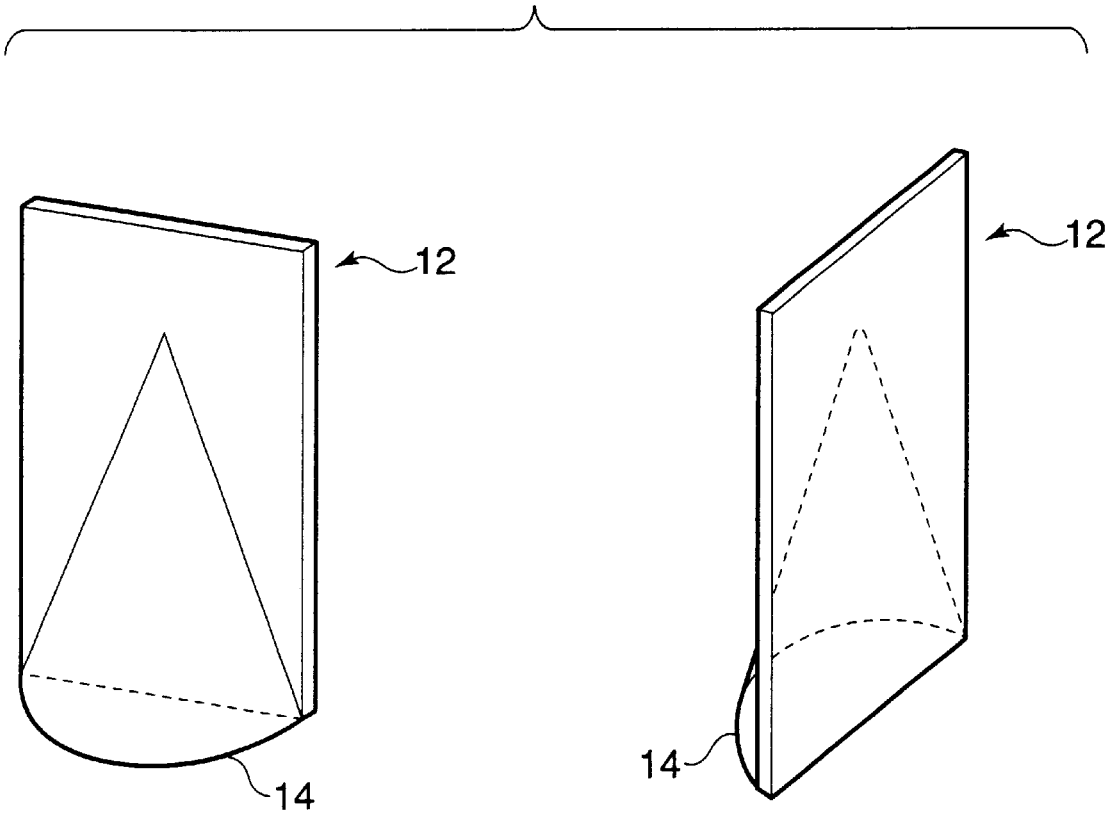
FIG. 3A is a perspective view of a guide plate.
Figure 3B:
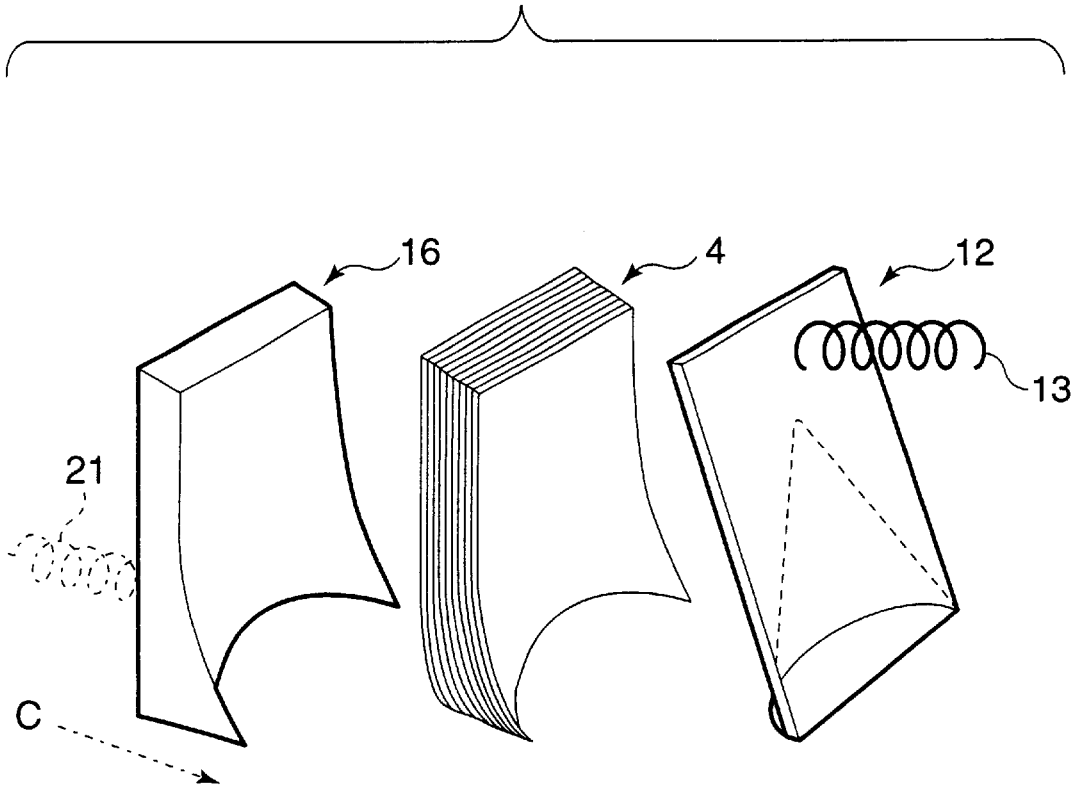
FIG. 3B is an exploded perspective view of a paper-feeding section.
Figure 3C:
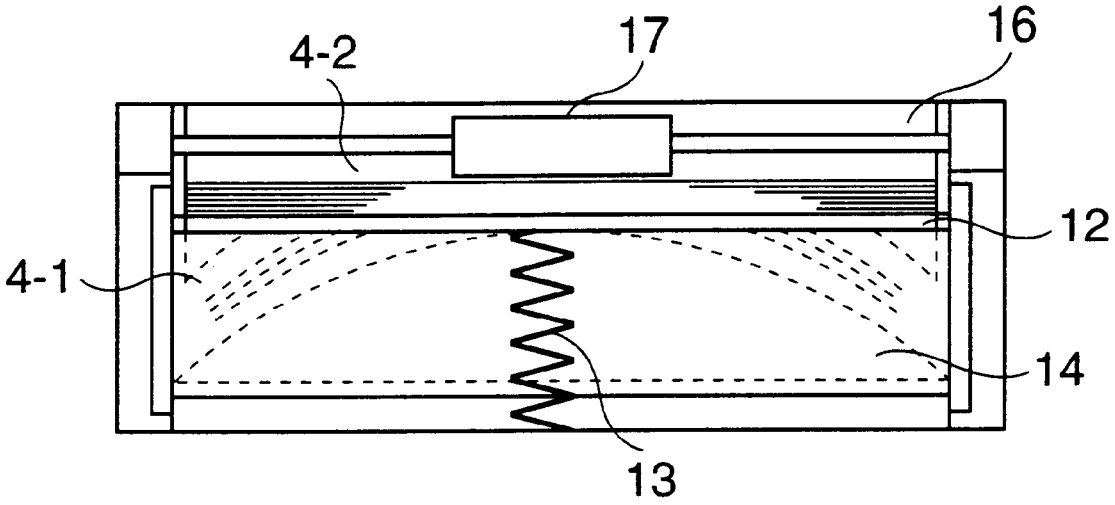
FIG. 3C is a cross-sectional top view of the paper-feeding section taken along lines III—III of FIG. 2.

FIG. 3A is a perspective view of a guide plate;

FIG. 3B is an exploded perspective view of a paper-feeding section;

FIG. 3C is a cross-sectional top view of the paper-feeding section taken along lines III—III of FIG. 2;

Referring to FIG. 3A, the guide 14 is in the shape of a part of a circular cone in which a cone has been partially cut away in a plane parallel to a center axis thereof. Thus, the guide 14 is convex whose diameter becomes smaller nearer a higher end portion of the guide 14. The guide 14 is attached to the guide plate 12.

Referring to FIG. 3B, the guide 16 is concave at a lower end portion thereof and is flat at a higher end portion thereof. The lower portion 41 of the print medium 4 is sandwiched by the guides 14 and 16 such that the print medium 4 is curved at its lower end portion. Therefore, the print medium 4 can withstand vertical stress exerted thereon and can be held in the upright position. Alternatively, the guide 14 may be provided on the main body 1 and the guide 16 on the guide plate 12, while still holding the print medium in the upright position. Still alternatively, a spring 21 may be provided to urge the guide 16 in a direction shown by arrow C against the stack of print medium 4 so that when remaining number of pages of the print medium becomes small, the stack of print medium still maintains its curved position at its lower end portion. Thus, the print medium may be oriented substantially vertical regardless of the remaining number of pages of print medium.

As shown in FIGS. 3B and 3C, the guide 12 is urged by the spring 132 against the stack of the print medium 4 in the upright position such that the guide 12 urges the top end portion 42 toward the hopping roller 17. The hopping roller 17 is in the shape of a cylinder, cut by a plane parallel to a longitudinal axis of the cylinder such that the hopping roller 17 has a D-shaped cross section. Therefore, the hopping roller 17 projects outwardly from the guide 16 toward the print medium 4 only when feeding the print medium 4 from the cassette 11, thereby not imposing a frictional load on the print medium 4. When the hopping roller 17 makes one complete rotation with the cassette 11 of FIG. 1 closed, the print medium 4 is fed out of the cassette 11 to the separator 8 and then to the registry roller 19. The separator 18 separates the top page from multiple pages of the print medium 4 if the hopping roller 17 simultaneously feeds more than one page to the separator inadvertently.

There is provided a sensor, not shown, in front of the registry roller 19 in order to detect the print medium 4 when the print medium 4 arrives at the registry roller 19. The registry roller 19 obstructs the print medium 4 eliminate the skew of the print medium 4. The registry roller 19 then rotates slightly and then stops, thereby firmly holding the leading end portion of the print medium 4.

{Image-forming Section}

The image-forming section 20 may take the form of an ink jet print engine, a plurality of electrophotographic print engines, or a plurality of thermal print engines. The display 2 of FIG. 2 indicates the operational status of the image-forming section.

When the image-forming section 20 of FIG. 1 is fully ready for a printing operation, the registry roller 19 feeds the print medium 4 in the upright position so that information is printed on the print medium 4 oriented in the upright position.

{Transporting section}

The transporting section 40 includes rollers 41 and carrier belts 42. One of the rollers 41 is connected to a drive source such as a motor. After information has been printed on the print medium, the carrier belts 42 upwardly transport the print medium 4 sandwiched therebetween. The print medium 4 is then redirected by the redirecting section 43 and discharged to the stacker 30.

{Stacker}

When the stacker 30 is opened, it takes up the dotted line position. The stacker 30 includes a stacker box 31, a stack guide plate 32, a sensor plate 33, a switch 34, a stopper 35, and a handle 36. The stopper 35 prevents the stacker box 31 from disengaging from the main body 1 when the top of the stacker box 31 is opened. The stack guide plate 32 is lightly urged by a torsion spring, not shown, outwardly from the apparatus, and yieldably guides the print medium 4. The urging force is selected such that when the print medium enters between the stack guide plate 32 and the front side of the stacker box 31, the print medium 4 is not suspended therebetween. The stack guide 32 holds the print medium 4 upright. The sensor plate 33 is disposed on the floor of the stacker box 31 and supports the print medium 4 in the stacker box 31. The sensor plate 33 is urged upward by a torsion spring such that the weight of a single page of the print medium 4 causes the switch 34 to close. The switch 34 takes the form of a micro switch or a photo-sensor that detects the upward and downward movements of the sensor plate 33.

{Operation}

When the image-forming section 20 receives a print instruction from a host apparatus such as a work station and a personal computer, not shown, the hopping roller operates to pick up the top page of the print medium 4 from the cassette 11. The top page of the print medium 4 passes through the separator 17 and then through the registry roller 19 to the image-forming section 20 located above the paper-feeding section 10. After the printing operation, the print medium 4 is transported further upwardly by the transporting section 40, so that the print medium 4 is then redirected by the redirecting section 43 into the stacker box 31. The inwardly projecting handle 36 serves to guide the print medium 4 to enter between the stack guide plate 32 so that the print medium 4 leans against the stack guide 32 with the printed surface facing the stack guide 32.

The handle 36 guides the following page to enter between the preceding page and the handle 36 so that the pages of print medium are stacked in the order in which they are printed.

When pages of the print medium 4 are stacked in the stacker box 31, the total weight of the pages pushes down the sensor plate 33. Thus, the switch 34 shifts to its ON position so that the LED of the display 3 of FIG. 2 lights up to indicate the presence of the print medium 4.

Upon completion of the printing operation, the user checks the LED on the display 3. If the LED has lit up, the user draws the handle 36 in a direction shown by arrow A and takes out the printed medium 4 from the stacker 30.

As mentioned above, the apparatus is relatively high but is of thin construction that occupies a smaller area on the floor of the office.

The present invention will be further described with respect to a case where the image-forming section 20 is a tandem type electrophotographic printer.

Figure 4:
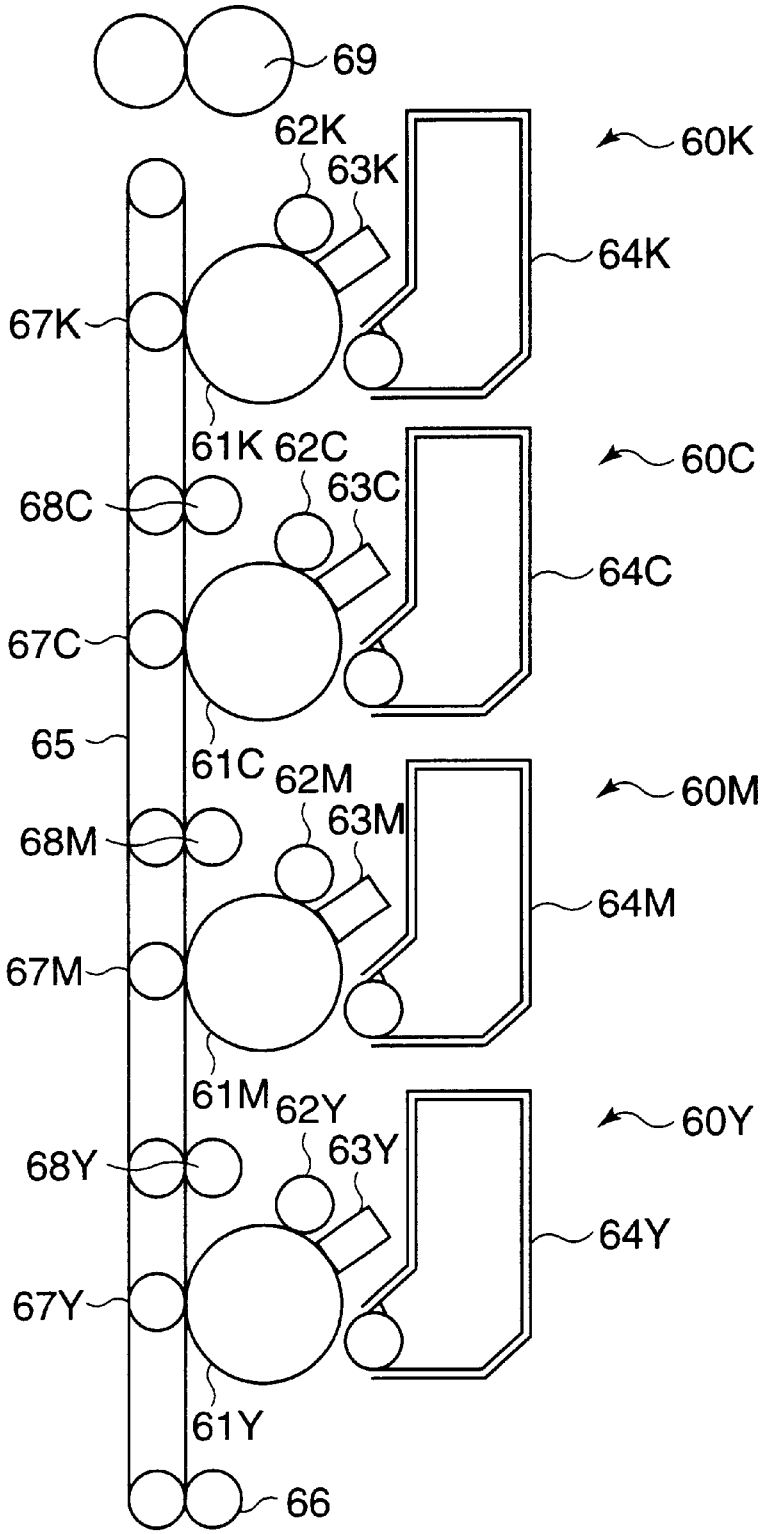
FIG. 4 illustrates a relevant portion of a print engine when the print engine takes the form of a tandem type electrophotographic printer.

FIG. 4 illustrates a relevant portion of a print engine.

Referring to FIG. 4, a tandem type electrcophotographic printer incorporates four print engines stacked upwardly in order: a yellow image drum cartridge 60Y, a magenta image drum cartridge 60M, a cyan image drum cartridge 60C, and a black image drum cartridge 60K.

The yellow image drum cartridge 60Y includes the following mechanisms: a photoconductive drum 61Y; a charging device 62Y with, for example a charging roller; an exposing unit 63Y in the form of, for example, an LED head; and a developing unit 64Y with, for example, a developing roller and a toner chamber.

The other image drum cartridges are of the same construction as the yellow image drum cartridge 60Y and differ only in the color of toner.

A carrier belt 65 is disposed to oppose the image drum cartridges 60Y–60K. A belt charging roller 66 is located at the lower end of the carrier belt 65 and causes the carrier belt 65 to be charged so that the carrier belt 65 attracts the print medium 4 electrostatically thereto and transports the print medium 4 upward.

Transfer rollers 67Y, 67M, 67C, and 67K are disposed such that the carrier belt 65 is sandwiched between the transfer rollers and corresponding photoconductive drums 61Y, 61M, 61C, and 61K.

Just as in known electrophotographic printers, the charging device charges the surface of the photoconductive drum. The exposing unit illuminates the charged surface of the photoconductive drum to form an electrostatic latent image thereon. Then, the developing unit applies toner to the electrostatic latent image to develop the electrostatic latent image with the toner into a toner image. Then, the transfer roller transfers the toner image onto the print medium.

Each of auxiliary fixing units 68Y, 68M, and 68C are disposed directly over a corresponding one of the transfer rollers 67Y, 67M, and 67C. The auxiliary fixing units 68Y, 68M, and 38C weakly fix the respective toner images on the print medium 4 at a lower temperature than a final fixing operation so that the toner images just remain transferred on the print medium. There is provided a fixing roller 69 over the transfer roller 67K and fully fixes the toner images on the print medium 4.

Since the toner images are weakly fixed by the respective auxiliary fixing units, the toner images will not come off the print medium 4 despite the fact that the print medium 4 is transported with the print medium 4 extending vertically. The auxiliary fixing operation requires only a low temperature, being advantageous in prolonging the life of the carrier belt as well as in saving overall power consumption.

As mentioned above, the present invention provides a board type image-forming apparatus of thin construction.

The image-forming apparatus according to the present invention occupies a small area on the floor of the office and can be used just like a part of a partition between departments in the office, allowing efficient utilization of office space.

Incorporating vertically stacked tandem type print engines is advantageous since the area occupied by the image-forming apparatus remains the same, while still allowing a highspeed color printing operation.

Second Embodiment

Figure 5:
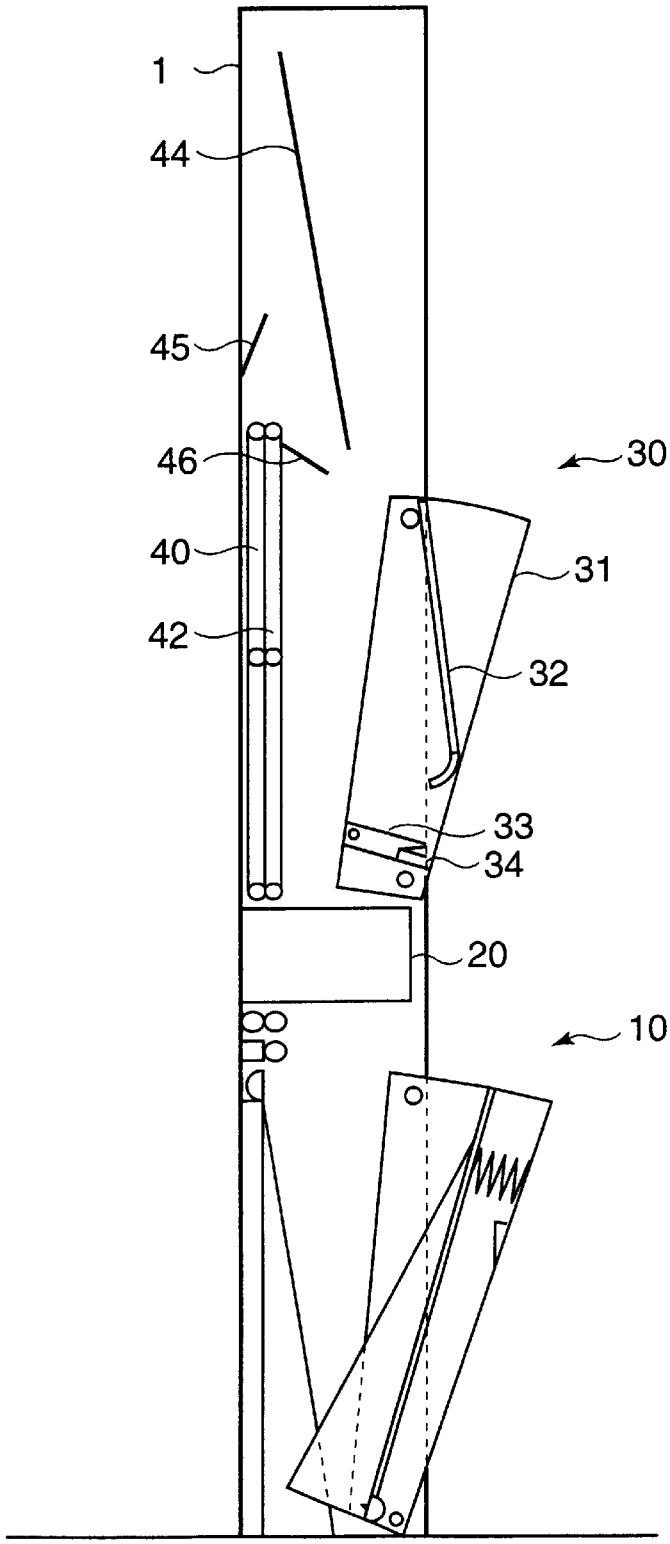
FIG. 5 is a cross-sectional view of a printer according to a second embodiment.

FIG. 5 is a cross-sectional view of a printer according to a second embodiment.

Referring to FIG. 5, the image-forming apparatus includes a paper-feeding section 10, an image-forming section 20 disposed over the paper-feeding section 10, a stacker 30 disposed over the image-forming section 20, and a transporting section 40. The paper-feeding section 10 and the image-forming section 20 are of the same construction as the first embodiment and the description thereof is omitted.

The stacker 30 according to the second embodiment has a transparent stacker box 31. In addition to the transporting roller 41 and carrier belt 42, the transporting section 40 is provided with a medium-orienting guide 44, rear end shifting guide 45, and fall guide 46.

The aforementioned construction of the second embodiment allows the print medium to be stacked with the printed surface facing outside, so that the printed surface is visible from outside of the main body 1.

{Operation and Construction of Transporting Section}

The operation and specific construction of the transporting section 40 will be described.

After printing, the medium-orienting guide 44 guides the print medium 4 so that the print medium 4 maintains its substantially vertical position and will not fall rightward of FIG. 5. For this purpose, the medium-orienting guide 44 is disposed over the carrier belts 42 such that the leading end of the print medium 4 is oriented only in a limited range of direction. The rear end shifting guide 45 guides the leading end of the print medium 4 rightward. For this purpose, the rear end shifting guide 45 is near the top of the carrier belt 42 so as to cause the leading end portion of the print medium to flex rightward toward the medium-orienting guide 44. The fall guide 46 guides the print medium 4 such that the leading end of the print medium 4 falls right downward. For smoothly guiding the print medium 4, the fall guide 46 is disposed with its upper end in close contact with the top end of the carrier belts 42 and with its lower end extending right downward.

Figure 6C:
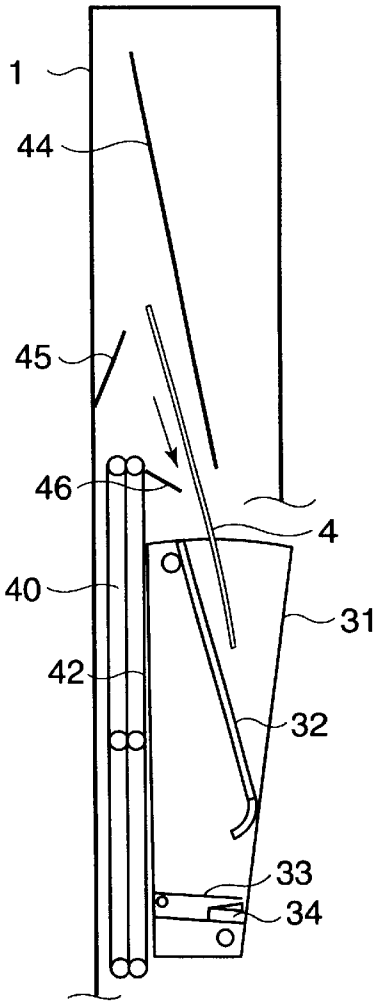
FIGS. 6A–6C illustrate the flow of the print medium in the printer of FIG. 5.
Figure 6B:
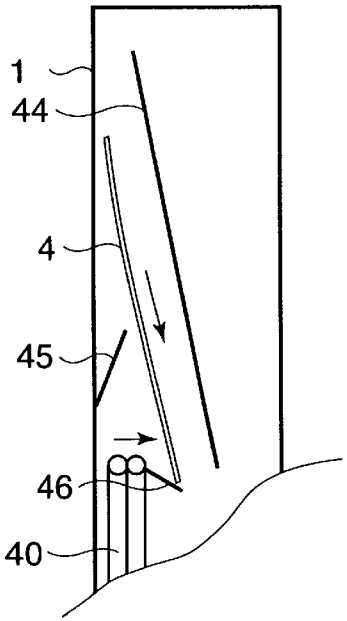
Figure 6A:
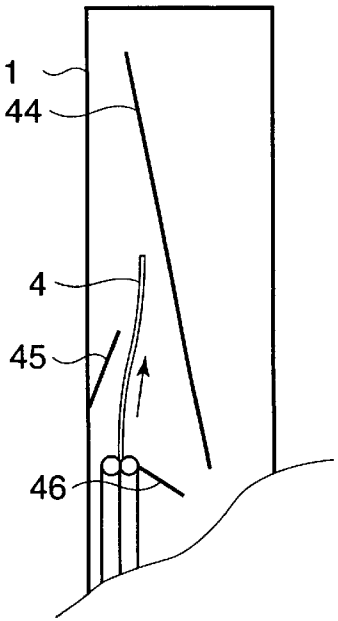

FIGS. 6A–6C illustrate the flow of the print medium.

The print medium 4 is guided by the aforementioned guides as follows:

When the leading end of the print medium 4 appears at the top end of the carrier belts as shown in FIG. 6A, the rear shifting guide 45 guides the leading end of the print medium 4 so that the print medium 4 advances along the medium-orienting guide 44. When the print medium 4 is further advanced, the trailing end of the print medium 4 leaves the carrier belts 42 as shown in FIG. 6B, while at the same time the print medium 4 is pushed rightward by the rear end shifting guide 45. As a result, the trailing end of the print medium 4 moves rightward and falls along the stack guide plate 32 as shown in FIG. 6C.

The printed surface of the print medium 4 is not turned over as opposed to the first embodiment. The print medium 4 is received in the stacker box. The print medium 4 extends substantially vertically though somewhat declining against the stack guide plate 32 with the printed surface facing rightward of FIG. 5. The pages of the print medium 4 are stacked one over the other.

Just as in the first embodiment, the sensor plate 33 and switch 34 cooperate to detect the stack of the print medium, so that when the print medium 4 is received in the stacker 30, an LED or the like lights up to indicate the presence of the print medium 4 to the user.

In the second embodiment, the vertically extending print medium 4 in the stacker box 31 is visible through the transparent stacker box 31. The visibility of the print medium 4 through the stacker box 31 eliminates the need of a visible indicator such as an LED to indicate the presence of the print medium in the stacker box 31.

If the image-forming section 20 is implemented in the form of a thermal printer, the overall size of the printer can be even thinner, so that the printed medium 4 in the transparent stacker box 31 can directly serve as a "poster" or a "bulletin board". When the printed medium 4 is posted, it does not require electric power as opposed to a CRT display or a plasma display that requires electric power. Thus, the image-forming apparatus according to the second embodiment can be used as an energy saving type display.

The recording apparatus according to the present invention has a paper-feeding section at a lower end of the apparatus and a paper stacker above the image-forming section. It is quite common that the paper cassette is usually supplied with a stack of 500 pages of print medium at a time. The stack of 500 pages is quite heavy and therefore it is desirable that the paper cassette is disposed at a relatively lower end of the apparatus in order to provide an easy-to-use apparatus.

Alternatively, the paper cassette may be disposed above the image-forming section and the paper stacker below the image-forming section. Then, the print medium is transported downwardly so that the print medium extends vertically due to its own weight. This may allow easy transportation of the print medium. Further, the downward transportation of the print medium allows feeding rollers to be used and eliminates the need for using carrier belts that were required to hold the print medium upright if the print medium was to be transported upwardly. Thus, the downward transportation of the print medium simplifies the construction of paper-transporting mechanism.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image-forming apparatus comprising:

a medium-feeding section, accommodating a stack of print media in a substantially upright orientation;

an image-forming section disposed in vertical alignment with said medium-feeding section, said image-forming section printing information on a page of print medium fed from said medium-feeding section; and a stacker disposed in vertical alignment with said image-forming section, said stacker receiving the page of the print medium that has been printed and accommodating the page of the print medium in a substantially upright orientation, said stacker holding said print medium in stacked relation between a front side wall member of the stacker and a backside wall member of the stacker;

wherein said image-forming apparatus is a board type in which said image-forming section is disposed over said medium-feeding section and said stacker is disposed over said image-forming section.

2. The image-forming apparatus according to claim 1, wherein said image-forming section is a tandem type electrophotographic apparatus with a plurality of image drum cartridges disposed in vertical alignment with one another.

3. An image-forming apparatus comprising:

a medium-feeding section;

an image-forming section disposed in vertical alignment with said medium-feeding section, said image-forming section printing information on a page of print media fed from said medium-feeding section; and a stacker disposed in vertical alignment with said image-forming section, said stacker receiving the page of the print medium that has been printed and accommodating the page of the print medium in a substantially upright orientation, wherein said stacker has a visible indicator that indicates to a user the presence and absence of the print medium.

4. The image-forming apparatus according to claim 3, wherein said stacker has a sensor that generates a detection signal of the print medium when the print medium is received therein, and said visible indicator indicates to-the user of the presence and absence of the print medium according to the detection signal.

5. The image-forming apparatus according to claim 3, wherein said stacker has a transparent portion that serves as said visible indicator.

6. An image-forming apparatus comprising:

a medium-feeding section having an at least partly curved portion to which a stack of print media is correspondingly configured so that a stack of print media is held in a substantially upright orientation;

an image-forming section disposed in vertical alignment with said medium feeding section, said image-forming section printing information on a page of the print medium fed from said medium-feeding section; and a stacker disposed in vertical alignment with said image-forming section, said stacker receiving the page of the print medium that has been printed and accommodating the page of the print medium in a substantially upright orientation.

7. An image-forming apparatus comprising:

a medium-feeding section, accommodating a stack of print media in a substantially upright orientation;

an image-forming section disposed in vertical alignment with said medium-feeding section, said image-forming section printing information on a page of print media fed from said medium-feeding section; and a stacker disposed in vertical alignment with said image-forming section, said stacker receiving a printed page of the print media such that the printed page of the print medium is accommodated in a substantially upright orientation;

wherein the image-forming apparatus is a board type in which the body is generally box-shaped and has a depth, a width greater than the depth, and a height greater than the width, the body having substantially flat outer surfaces such that the body, said stacker and the print medium feeding section being included within the body during a printing operation.

* * * * *